US008646653B2

(12) United States Patent
Lien et al.

(10) Patent No.: US 8,646,653 B2
(45) Date of Patent: Feb. 11, 2014

(54) DISPENSING ASSEMBLY AND PACKAGE OF ARTICLES

(75) Inventors: Khoa T. Lien, Milton, GA (US); Kosol Petrach, SongKhia (TH)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 13/358,107

(22) Filed: Jan. 25, 2012

(65) Prior Publication Data

US 2013/0186800 A1 Jul. 25, 2013

(51) Int. Cl.

| | |
|---|---|
| ***A47F 1/04*** | (2006.01) |
| ***B65H 1/00*** | (2006.01) |
| ***B65D 85/16*** | (2006.01) |
| ***B65D 17/28*** | (2006.01) |

(52) U.S. Cl.

USPC ..... 221/305; 206/494; 221/45; 229/122

(58) Field of Classification Search

USPC ..... 206/233, 278, 494; 221/33, 34, 37, 221/45–63, 302, 305; 229/109, 122, 229/237–242, 117.13–117.16

See application file for complete search history.

(56) References Cited

U.S. PATENT DOCUMENTS

| | | | | |
|---|---|---|---|---|
| 3,243,079 | A | 3/1966 | Rettmer | |
| 3,272,385 | A * | 9/1966 | Watkins | 221/48 |
| 3,403,815 | A | 10/1968 | Robson | |
| 3,533,549 | A | 10/1970 | Gilchrist | |
| 3,746,152 | A | 7/1973 | Allen | |
| 3,940,054 | A | 2/1976 | Goebel | |
| 3,982,685 | A | 9/1976 | Shimada | |
| 4,158,412 | A | 6/1979 | Wysocki | |
| 4,844,293 | A | 7/1989 | McLaughlin | |
| 4,997,105 | A | 3/1991 | Fischer | |
| 5,044,494 | A | 9/1991 | Tamura | |
| 5,096,089 | A | 3/1992 | McLaughlin | |
| 5,219,421 | A * | 6/1993 | Tipping | 221/63 |
| 5,259,550 | A * | 11/1993 | Kuchenbecker | 229/109 |
| 5,542,598 | A * | 8/1996 | Capo | 229/242 |
| 5,816,440 | A | 10/1998 | Shields | |
| 5,921,434 | A | 7/1999 | Hollander | |
| 5,927,543 | A | 7/1999 | Dejardin | |
| 6,112,936 | A | 9/2000 | Arizmendi | |
| 6,267,262 | B1 | 7/2001 | Wilner | |
| D460,301 | S | 7/2002 | Milliorn | |

(Continued)

FOREIGN PATENT DOCUMENTS

| | | |
|---|---|---|
| GB | 2 008 542 A | 6/1979 |
| GB | 4014914 | 3/2005 |

(Continued)

*Primary Examiner* — Bryon Gehman

(74) *Attorney, Agent, or Firm* — Karl V. Sidor

(57) ABSTRACT

A dispensing assembly for dispensing articles such as disposable gloves. The assembly includes a container having a plurality of panels. The panels define a chamber and a dispensing region on the container. The assembly also includes a removable section in the dispensing region. The removable section has a first portion outlining a first orifice and at least a second portion outlining a second orifice that subtends the first portion. The dispensing assembly also includes a first component to remove only the first portion of the removable section and at least a second component to simultaneously remove both the first portion and at least the second portion of the removable section such that removal of the first component forms the first orifice and removal of the second component forms a second orifice into the chamber that incorporates the first orifice.

19 Claims, 4 Drawing Sheets

(56) References Cited

U.S. PATENT DOCUMENTS

| | | | | |
|---|---|---|---|---|
| 6,488,175 | B2 | 12/2002 | Shiffler | |
| 6,543,642 | B1 | 4/2003 | Milliorn | |
| 6,715,633 | B2 * | 4/2004 | Thoms | 221/37 |
| 6,886,714 | B2 | 5/2005 | Kruchoski | |
| D530,224 | S | 10/2006 | Mattesky | |
| D569,719 | S | 5/2008 | Ross | |
| 7,661,554 | B2 * | 2/2010 | Szymonski et al. | 221/50 |
| 7,699,189 | B2 | 4/2010 | Tramontina | |
| 7,731,056 | B2 | 6/2010 | Tramontina | |
| 7,874,455 | B2 | 1/2011 | Jordan | |
| 7,992,744 | B2 * | 8/2011 | Szymonski et al. | 221/37 |
| 2004/0245269 | A1 | 12/2004 | Grinberg | |
| 2005/0150788 | A1 | 7/2005 | Feusner | |
| 2006/0049199 | A1 | 3/2006 | West | |
| 2007/0210096 | A1 | 9/2007 | Ellswood | |
| 2007/0215630 | A1 | 9/2007 | Tramontina | |
| 2009/0261001 | A1 | 10/2009 | Yao | |
| 2011/0062179 | A1 | 3/2011 | Stollery | |

FOREIGN PATENT DOCUMENTS

| | | | |
|---|---|---|---|
| GB | 4014915 | | 3/2005 |
| GB | 4014916 | | 3/2005 |
| GB | 2449087 | A | 11/2008 |
| GB | 2451450 | A | 2/2009 |
| GB | 2459781 | A | 11/2009 |
| JP | 2007297079 | A | 11/2007 |
| JP | 2011162257 | A | 8/2011 |
| WO | WO 97/22528 | A1 | 6/1997 |

* cited by examiner

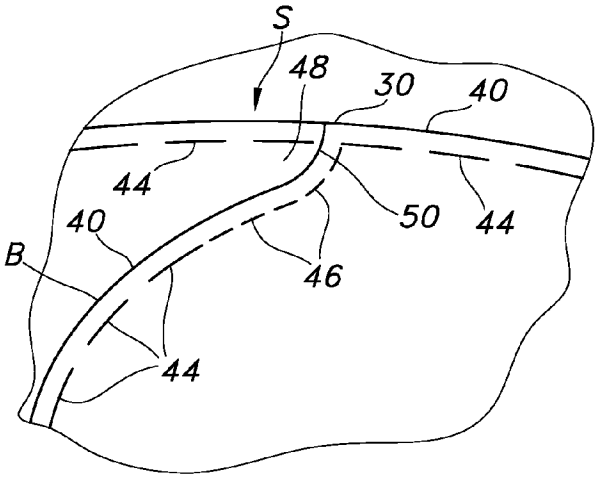
FIG. 6
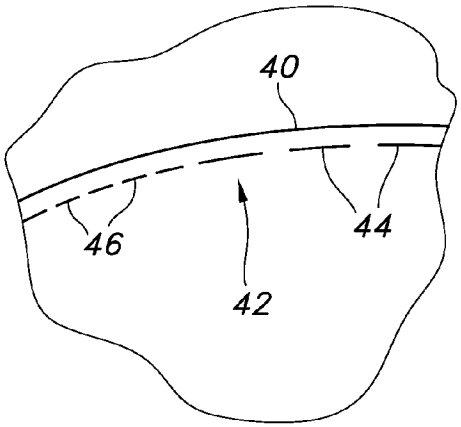
FIG. 5
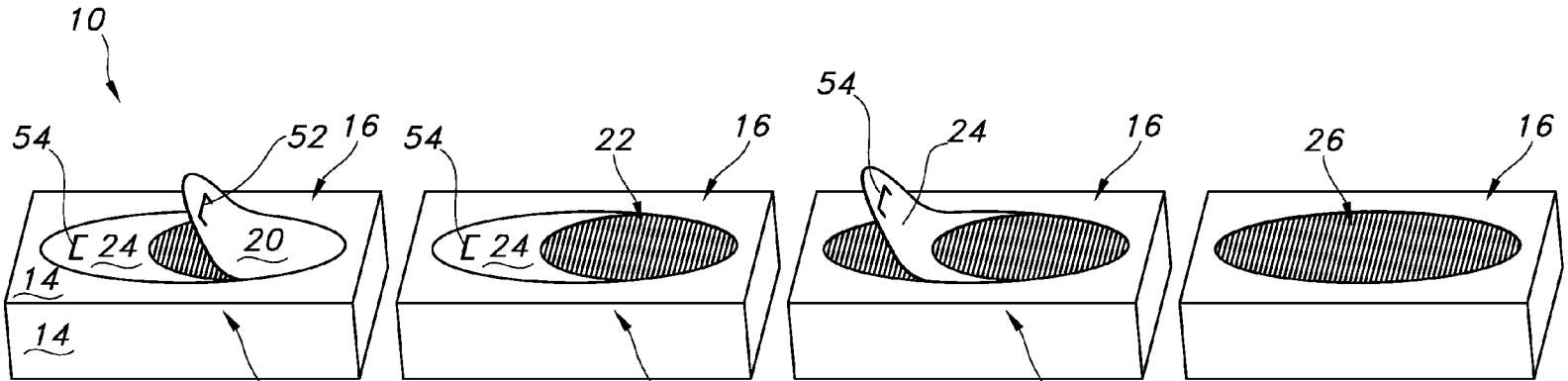
FIG. 7A
FIG. 7B
FIG. 7C
FIG. 7D

DISPENSING ASSEMBLY AND PACKAGE OF ARTICLES

FIELD OF THE INVENTION

The present invention relates in general to dispensing cartons having tear-out orifice covers.

BACKGROUND OF THE INVENTION

A variety of single use, disposable products such as gloves, facemasks and the like are packaged in dispensing cartons. These dispensing cartons frequently have a tear-out opening or dispensing orifice cover.

Exemplary cartons or carton modifications for dispensing a variety of products including surgical gloves, tissues, dust mitts, and disposable gloves, are described at, for example:

U.S. Pat. No. 3,746,152 for "Surgical Glove Carton" issued to Allen on Jul. 17, 1973, describes a flat, sterilizable carton that is configured to store a pair of surgical gloves for an extended period in sterile condition and then "snap open" to a flat configuration and also lock in the flat configuration to present the surgical gloves to a user on a sterile field of cardboard.

U.S. Pat. No. 6,112,936 for "Medical Glove Dispensing Enclosure" issued to Arizmendi on Sep. 5, 2000, describes an envelope made of tubular net material that is stretched around a glove dispensing box or the like such that a sphincter closure in the net material is located over an opening in the dispensing box. The sphincter closure is made by cutting a hole in the net material and weaving an elastic band around the hole.

U.S. Pat. No. 6,488,175 for "Dusting Mitt Dispensing System" issued to Shiffler et al., on Dec. 3, 2002, describes a dispensing system for dispensing dusting mitts that have a thumb that is folded and arranged to present the thumb at the top of a stack of mitts. The dispensing system includes a carton having a top cover that pivots along a top seam at the back of the carton. The top cover contains a perforation pattern that forms an access flap when the perforations are severed. The access flap is integrally connected to the top cover along a seam to provide access to the contents.

U.S. Pat. No. 6,886,714 for "Container Allowing Choice of Multiple Openings for Dispensing Preference" issued to Kruchoski et al., on May 3, 2005, describes a dispensing container for dispensing sheets in which the container has a first dispensing opening for pop-up dispensing of sheets such as facial tissue. The container has a second opening to provide group dispensing of a plurality of sheets simultaneously without having to disassociate the sheets from each other. The openings can be overlayed on each other, or one opening can be placed on one portion of the container and another opening on another portion of the container to provide a consumer with various dispensing options.

U.S. Patent Application Publication No. US 2007/0210096 A1 for "High-Volume Package Dispense" by Ellswood et al., published on May 3, 2005, describes a dispenser package system for protective articles, having a substantially vertical product storage orientation and package design. The package includes a double or multi-chambered dispenser unit that can provide within substantially the same footprint as a conventional dispenser container a greater volume of product. The package can store and dispense at least 50 percent, up to about 200 percent or greater capacity than conventional dispenser for protective article products such as gloves or face masks.

While these cartons or carton modifications for dispensing a variety of products provide improvements, the each fail to recognize or address the need for allowing a user to select a first orifice to access the interior of a container and subsequently expand the orifice to enhance access to the interior of the container. These cartons or carton modifications also fail to recognize or address the need for allowing a user to select between two different sized orifices at the same location on a carton. Meeting this need is important because carton sizes are increasing and the larger cartons present difficulties dispensing individual products such as examination gloves as the quantity of products become depleted to a level that the products are no longer located near the orifice. The need is particularly apparent for larger volume packages having contents that may settle or become difficult to access, particularly in a health care environment.

BRIEF SUMMARY OF THE INVENTION

The problems described above are addressed by the present invention which encompasses a dispensing assembly for dispensing articles such as disposable gloves. The assembly includes a container having a plurality of panels. The panels define a chamber and a dispensing region on the container. The assembly also includes a removable section in the dispensing region. The removable section has a first portion outlining a first orifice and at least a second portion outlining a second orifice that subtends the first portion. For example, the first portion may be completely surrounded by the second portion. Alternatively, the first portion and the second portion may be merged in at least one zone such that the first dispensing orifice and at least the second dispensing orifice are each defined by a common edge of the dispensing region.

In an aspect of the invention, the first portion of the removable section may have an oval shape and the second portion of the removable section may have a generally crescent shape that extends or expands the oval shape of the first portion. The first portion and the second portion (or additional portions) of the removable section may have a variety of shapes, sizes or configurations. The first portion of the removable section may be the same size or may be larger than the second portion of the removable section. Alternatively, the first portion of the removable section may be smaller than the second portion of the removable section. The first portion and second portion of the removable section may be defined by perforations, scores, underscores, partial cuts through the material and combinations thereof.

The dispensing assembly also includes a first component to remove only the first portion of the removable section and at least a second component to simultaneously remove both the first portion and at least the second portion of the removable section such that removal of the first component forms the first orifice (providing access to the chamber) and removal of the second component forms a second orifice (providing access to the chamber) that incorporates the first orifice. In an aspect of the invention, the second component is configured to remove at least the second portion of the removable section that remains after the first portion is removed. The first and second removal components are selected from flaps, tabs, finger recesses, indentations, or the like and combinations thereof.

According to the invention, the dispensing assembly may further include indicia identifying at least one of the following: the first component, the second component, the first portion of the removable section, the second portion of the removable section, and combinations thereof.

The present invention also encompasses a dispensing assembly that includes a container having a plurality of panels. These panels define a chamber and a dispensing region on the container. The assembly also includes a removable section in the dispensing region. The removable section has a first portion outlining a first orifice and at least a second portion outlining a second orifice that subtends the first portion. The assembly also includes a first component to remove only the first portion of the removable section to define a first orifice and at least a second component to: (i) simultaneously remove both the first portion and the second portion of the removable section to define a second orifice that incorporates the first orifice; or (ii) remove at least the second portion of the removable section that remains after the first portion of the removable section is removed.

The present invention also encompasses a package of articles. The package includes a container having or including a plurality of panels configured to define a chamber and a dispensing region on the container; a removable section in the dispensing region of the container, the removable section having a first portion outlining a first dispensing orifice and at least a second portion; and a first component to remove only the first portion of the removable section to define a first dispensing orifice providing access into the chamber and at least a second component to: (i) simultaneously remove both the first portion and the second portion of the removable section to define a second orifice providing access into the chamber that is larger than and incorporates the first orifice; or (ii) remove at least the second portion of the removable section that remains after the first portion of the removable section is removed. The package also includes a plurality of articles disposed within the chamber of the container, each article in communication with but not attached to another article. According to the invention, initial access to the plurality of articles within the chamber of the container may be obtained utilizing the first orifice and subsequent access may be obtained utilizing the second orifice or initial access to the plurality of articles may be achieved utilizing only the second orifice.

Other objects, advantages and applications of the present disclosure will be made clear by the following detailed description of a preferred embodiment of the disclosure and the accompanying drawings wherein reference numerals refer to like or equivalent structures.

DESCRIPTION OF THE DRAWINGS

FIG. 5 is a top view illustrating a detail of an exemplary dispensing assembly highlighting a segment of an exemplary combination of half cut and perforations that outline a portion of a removable section.

FIG. 6 is a top view illustrating a detail of an exemplary dispensing assembly highlighting an exemplary shoulder area of a second portion of a removable section in which a shoulder of the second portion has a truncated end.

FIGS. 7A to 7D are perspective view illustrations showing a sequence of opening an exemplary dispensing assembly.

DETAILED DESCRIPTION

Figure 1:
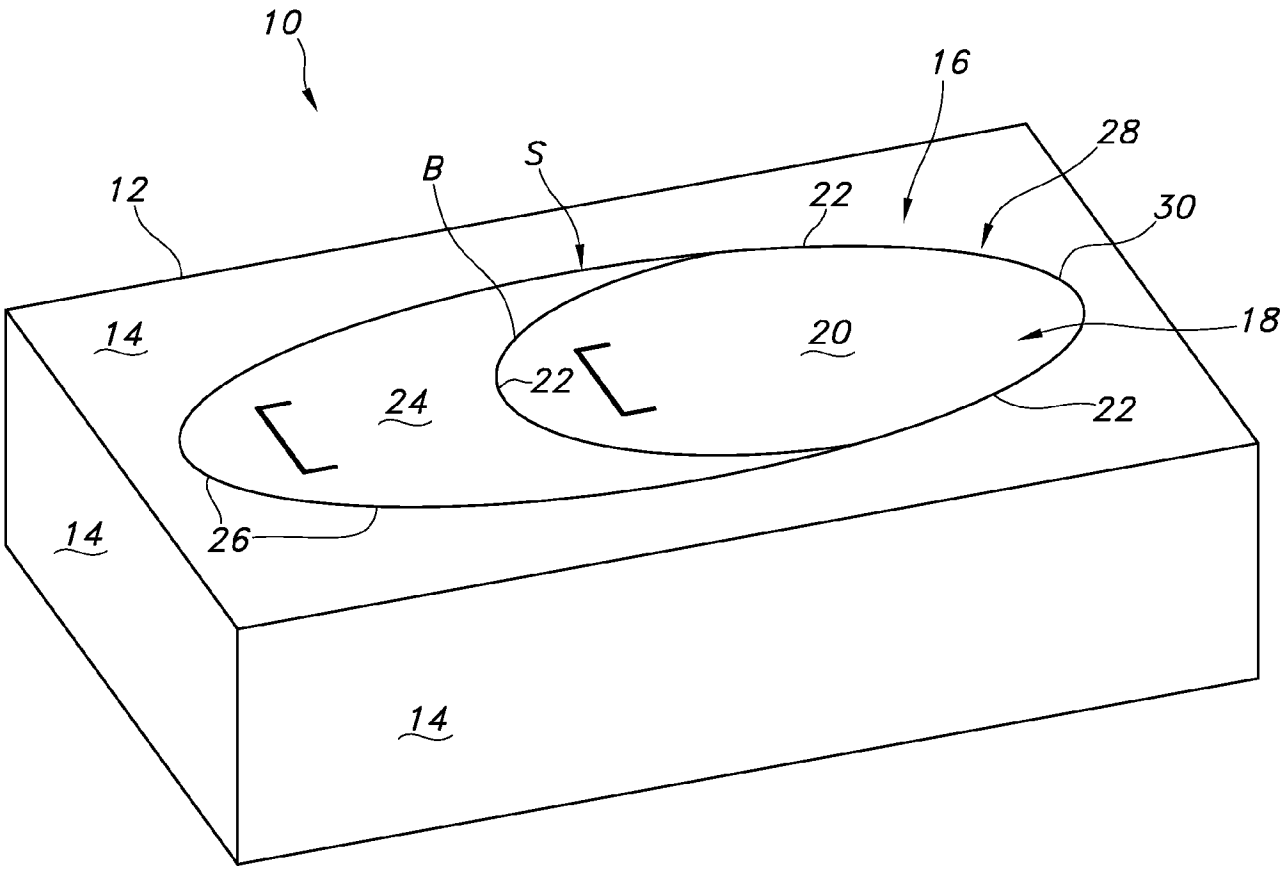
FIG. 1 is a perspective view illustration of an exemplary dispensing assembly for dispensing articles such as disposable gloves.

Reference will now be made in detail to one or more embodiments, examples of which are illustrated in the drawings. It should be understood that features illustrated or described as part of one embodiment may be used with another embodiment to yield still a further embodiment.

Turning now to the drawings, there is shown at FIG. 1 an exemplary dispensing assembly 10 for dispensing articles such as, for example, disposable examination gloves, facemasks or the like. The dispensing assembly 10 includes a container 12 having a plurality of panels 14. The panels may be any suitable material such as, for example, carton cardboard stock, paperboard, heavy structural paper, container stock, corrugated paperboard, plastic coated paper, plastic sheets, wax-coated papers or the like, and combinations thereof.

The panels 14 define a chamber "C" and a dispensing region 16 on the container. The assembly also includes a removable section 18 in the dispensing region. The removable section has a first portion 20 outlining a first orifice 22 and at least a second portion 24 outlining a second orifice 26 that subtends the first portion 20. As used herein, the term "subtends" refers to the relationship between a first portion and a second portion such that one portion may be adjacent to and delimit the other portion. For example, one component may be discrete component yet can be incorporated or subsumed into a second component.

Figure 2:
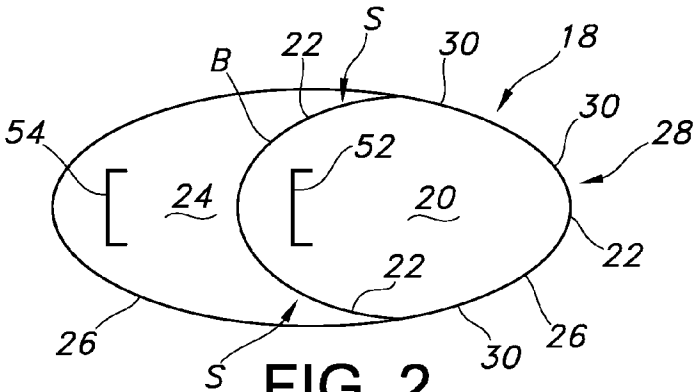
FIG. 2 is a top plan view of a detail of a dispensing assembly illustrating an exemplary first portion and second portion of the removable section located in the dispensing region.
Figure 3:
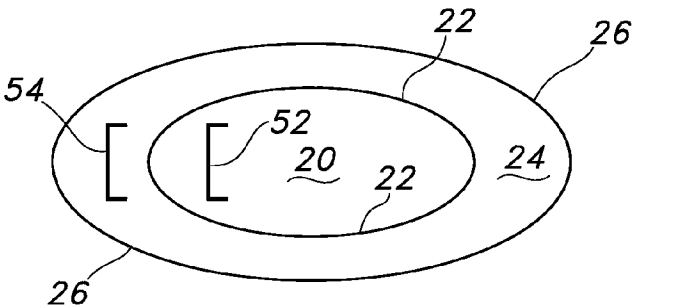
FIG. 3 is a top plan view of a detail of a dispensing assembly illustrating another exemplary first portion and second portion of the removable section located in the dispensing region. The first portion is surrounded by the second portion.

Referring to FIG. 2, there is shown a top plan view of the removable section 18 highlighting the first portion 20 and the second portion 24. In FIG. 2, the second portion 24 subtends the first portion 20 in that it is adjacent to the first portion 20 and shares a common boundary "B". As is illustrated in FIG. 2, the first portion 20 and the second portion 24 may be merged in at least one zone 28 such that the first orifice 22 and at least the second orifice 26 are each defined by a common edge 30 of the dispensing region. In such configuration, the first portion 20 of the removable section may be described as having an oval shape and the second portion 24 of the removable section may be described as having a generally crescent shape that extends or expands the oval shape of the first portion. Alternatively, the first portion 20 may be completely surrounded by the second portion 24 as illustrated in FIG. 3.

Figure 4A:
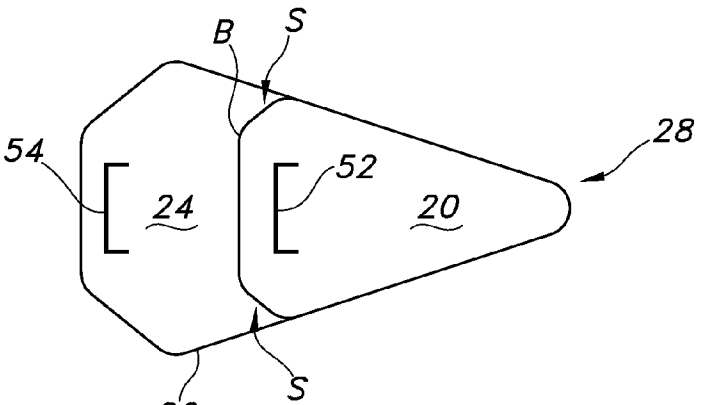
FIG. 4A is a top plan view of a detail of a dispensing assembly illustrating another exemplary first portion and second portion of the removable section located in the dispensing region.

The first portion and the second portion (or yet other additional portions) of the removable section may have a variety of shapes, sizes or configurations. For example, as illustrated in FIG. 4A, the first portion 20 may have a generally triangular shape and the second portion 24 may have a different geometry such as, for example, an approximately hexagonal shape. As illustrated in FIG. 4B, the first portion 20 of the removable section may be larger than the second portion 24 of the removable section. That is, the first portion 20 may have an area that is greater than the area of the second portion 24.

Figure 4C:
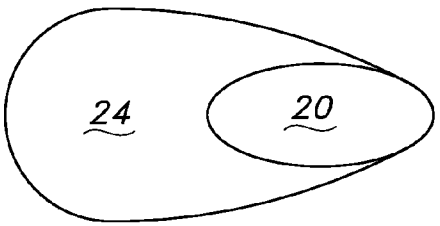
FIG. 4C is a top plan view of a detail of a dispensing assembly illustrating another exemplary first portion and second portion of the removable section located in the dispensing region. The first portion is smaller than the second portion.
Figure 4B:
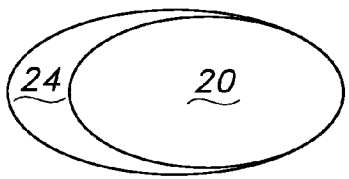
FIG. 4B is a top plan view of a detail of a dispensing assembly illustrating another exemplary first portion and second portion of the removable section located in the dispensing region. The first portion is larger than the second portion.

Alternatively, the first portion 20 of the removable section may be smaller than the second portion 24 of the removable section as illustrated in FIG. 4C. That is, the first portion 20 may have an area that is less than the area of the second portion 24. Of course, the first portion 20 and the second portion 24 may be approximately the same size—that is, the first portion 20 and the second portion 24 may have approximately the same area.

The first portion and second portion of the removable section may be defined by perforations, scores, underscores, or partial cuts through the material and combinations thereof. Such features are known to those of ordinary skill in the art. For example, U.S. Pat. No. 4,153,412 for "Tear Out Opening Device" issued to Wysocki on Jun. 19, 1979, describes half-cut configurations used for a tear out flap, the contents of which are incorporated herein by reference.

Referring now to FIG. 5 of the drawings, there is shown an exemplary combination of half cut and perforations. For example, the first portion and the second portion may have an outermost or exterior outline formed by a solid half-cut 40 through the panels and an inner or interior outline formed of spaced apart perforations 42 of the type typically used to define a tear away portion of a container or package. These perforations may desirably be uniformly spaced apart throughout the outline of each portion. For example, these perforations may be separated by about 1 millimeter of panel material. More desirably, these perforations 42 may be composed of various length cuts such that longer perforations 44 enhance the ease of removing the portions of the removable sections from the dispensing region and the shorter perforations 46 provide more resistance against removal. As an example, the longer perforations may have a length of about 5 millimeters separated by about 1 millimeter of panel material and the shorter perforations may have a length of about 2 millimeters separated by about 1 millimeter of panel material. In this example, the shorter perforations would provide approximately 50% more panel material than the longer perforations over an exemplary 18 millimeter span. Of course, other perforation lengths are contemplated and other spans of panel material are contemplated. As a non-limiting example, the longer perforations may be from about 2.5 millimeters to about 8 millimeters and the shorter perforations may be from about 0.5 millimeters to about 2 millimeters. Of course, other lengths beyond this range are contemplated and are possible. The span of panel material between the perforations may be from 0.1 millimeters to 3 millimeters and more desirably from about 0.5 millimeters to about 1.5 millimeters. Other lengths are contemplated and are possible.

According to an aspect of the invention, the second portion 24 may be designed to have shoulder areas "S" as illustrated in FIGS. 2 and 4A. Referring now to FIG. 6 of the drawings, there is illustrated an exemplary shoulder area S in which the shoulder 48 of the second portion 24 has a truncated end 50. Such a truncated end 50 helps provide a clean separation between the first portion 20 and the second portion 24 when the first portion 20 is removed before the second portion 24 is removed. In addition, the inventors have found that utilizing a combination of shorter perforations 46 and longer perforations 44 also enhances the clean separation between the first portion 20 and the second portion 24. For example, the boundary B may be composed of a half-cut line 40 and shorter perforations 46 near the truncated end 50 of the shoulder 48 and longer perforations 44 away from the shoulder 48. The common edge 30 of the dispensing region may be composed of a half-cut line 40 and generally longer perforations 44. In the region immediately adjacent the shoulder 48, it has been found desirable to shorten the perforations defining the common edge 30 to enhance the stability of the shoulder 48 and provide a clean separation between the first portion 20 and the second portion 24 when the first portion is removed before the second portion.

According to the invention, the dispensing assembly also includes a first component 52 to remove only the first portion 20 of the removable section and at least a second component 54 to simultaneously remove both the first portion 20 and at least the second portion 24 of the removable section. The first and second removal components 52, 54 may be flaps, tabs, rings, finger recesses, indentations, or the like and combinations thereof.

Referring now to FIGS. 7A to 7D, there is illustrated in perspective view an exemplary sequence of opening an exemplary dispensing assembly 10. Removal of the first portion 20 utilizing the first component 52 forms the first orifice 22 (providing access to the chamber) in the dispensing region 16 and removal of the second portion 24 utilizing the second component 54 forms a second orifice 26 (providing access to the chamber) in the dispensing region 16. As can be seen in this sequence, the second orifice 26 incorporates or subtends or subsumes the first orifice 20. As illustrated in this sequence, the second component 54 is configured to remove the second portion 24 of the removable section 18 that remains after the first portion 20 is removed utilizing the first component 52.

Figure 8A:
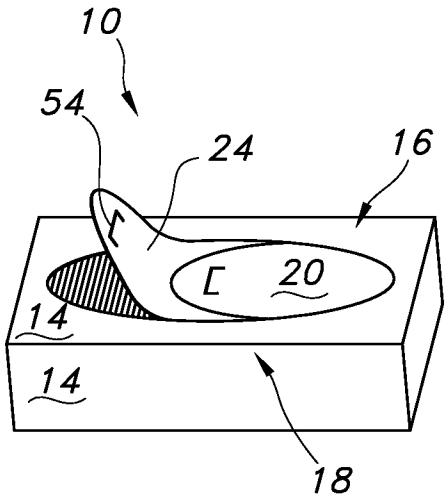
FIGS. 8A to 8C are perspective view illustrations showing an alternate sequence of opening an exemplary dispensing assembly.
Figure 8B:
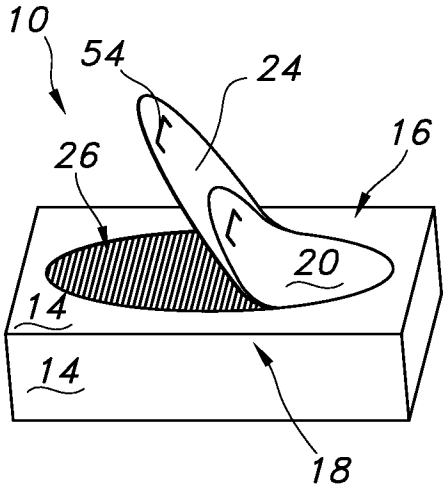
Figure 8C:
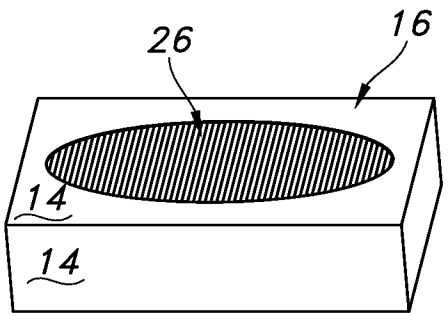

Referring now to FIGS. 8A to 8C, there is illustrated in perspective view an alternative exemplary sequence of opening an exemplary dispensing assembly 10. Utilizing the second component 54, both the first portion 20 and the second portion 24 are removed from the dispensing region 16 providing access to the chamber utilizing a second orifice 26 (providing access to the chamber) in the dispensing region 16. As can be seen in this sequence, the first portion 20 is removed simultaneously with the second portion 24.

According to the invention, the dispensing assembly may further include indicia identifying at least one of the following: the first component, the second component, the first portion of the removable section, the second portion of the removable section, and combinations thereof. These indicia may be used to provide instructions to a user about how to utilize the first component 52 to initially remove the first portion 20 of the removable section 18 and then how to subsequently utilize the second component 54 to remove the second portion 24 that remains after the first portion of the removable section 18 is removed. Alternatively and/or additionally, the indicia may be used to provide instructions to a user about how to utilize the second component 54 to remove the first portion 20 and the second portion 24 simultaneously.

The present invention also encompasses a package of articles. The package includes a container having or including a plurality of panels configured to define a chamber and a dispensing region on the container; a removable section in the dispensing region of the container, the removable section having a first portion outlining a first dispensing orifice and at least a second portion; and a first component to remove only the first portion of the removable section to define a first dispensing orifice providing access into the chamber and at least a second component to: (i) simultaneously remove both the first portion and the second portion of the removable section to define a second orifice providing access into the chamber that is larger than and incorporates the first orifice; or (ii) remove at least the second portion of the removable section that remains after the first portion of the removable section is removed. The package also includes a plurality of articles disposed within the chamber of the container, each article in communication with but not attached to another article. According to the invention, initial access to the plurality of articles within the chamber of the container may be obtained utilizing the first orifice and subsequent access may be obtained utilizing the second orifice or initial access to the plurality of articles may be achieved utilizing only the second orifice.

The plurality of articles is desirably a plurality of disposable articles. As used herein, the term "disposable" refers to a product that is so inexpensive that it may economically be discarded after only a single use. Products that are "disposable" are typically intended for single use. The term "single-use" refers to a product that is intended to be used for only once and is not intended to be re-used, re-conditioned, restored or repaired after that use. These products offer advantages in clinical settings by reducing the potential for contamination or infection. In addition, these products can enhance work flow since they are not collected and assembled for reprocessing and reuse. Examples of disposable articles include disposable examination gloves, disposable face-masks and the like.

Dispensing disposable examination gloves from a package can be particularly difficult. For smaller-sized examination gloves, such as, for example, standard small or extra-small sizes, users may wish to have a smaller orifice to access the contents of the carton to prevent gloves from spilling out. The size of these gloves may be close to or not much larger than the size of the orifice. In some cases, the dimensions of the gloves may be smaller than the size of the orifice. This is particularly notable when the dispensing carton is initially opened and the contents are immediately adjacent the orifice. However, for larger-sized examination gloves, such as, for example, standard large or extra-large sizes, users may wish to have a larger orifice to provide for easier dispensing from the carton. The size of these gloves may be larger or even much larger than a typical glove dispensing orifice. The present invention allows the user to select a dispensing orifice. For example, the user may use the first component 52 to remove the first portion 20 to provide a smaller orifice 22 if the contents of the package/dispensing assembly 10 are smaller-sized articles such as smaller-sized examination gloves. The present invention also allows the user to use the second component 54 to simultaneously remove the first portion 20 and the second portion 24 if the contents of the package/dispensing assembly 10 are larger-sized articles such as larger-sized examination gloves. Thus, the dispensing assembly 10 is suitable for use with either smaller-sized or larger-sized articles (e.g., examination gloves) without requiring customized modifications to the dispensing assembly/package during manufacture. That is, the user is able to easily select between two different sized orifices at the same location on a carton and remove the appropriate portion to deploy the orifice.

In order to improve economy, dispensing assemblies or packages are frequently larger in size to hold larger quantities of articles. When dispensing articles such as, for example, disposable examination gloves from a larger carton or package, dispensing becomes problematic after a sufficient quantity of articles (e.g., gloves) is depleted so the gloves are no longer readily accessible near the orifice. Users are forced to tip the dispensing assembly or package or even insert their fingers or entire hand deep into the package to grasp and withdraw an article. The orifice is typically about the same size as the user's hand, so mobility as well as vision inside the package (e.g., the chamber of the dispensing assembly) is restricted.

The present invention allows a user to select a first orifice to access the interior of a container and subsequently expand the orifice to enhance access to the interior of the container. This is particularly important for larger volume packages having contents that may settle or become difficult to access, especially in a health care environment.

For example, the present invention allows the user to use the first component 52 to remove the first portion 20 to provide a smaller orifice 22 for initial dispensing of articles such as, for example, examination gloves from a large container. As the contents settle or a sufficient quantity of articles (e.g., gloves) is depleted so the gloves are no longer readily accessible near the orifice, the present invention also allows the user to use the second component 54 to remove the second portion 24 of the removable section 18 that remains after the first portion 20 of the removable section was removed. Thus, the dispensing assembly 10 is suitable for use with large containers without requiring customized modifications to the dispensing assembly/package during manufacture. That is, the user is able to initiate access to the plurality of articles within the chamber of the container by removing the first portion 20 of the removable section to provide the first orifice 22 and then expand the first orifice 22 by removing the second portion 24 of the removable section that remains after the first portion 20 of the removable section was removed. That is, the user is able to easily expand a first orifice into a second, larger orifice at the same location on a container to increase access to articles in a large container.

While various patents have been incorporated herein by reference, to the extent there is any inconsistency between incorporated material and that of the written specification, the written specification shall control. In addition, while the disclosure has been described in detail with respect to specific embodiments thereof, it will be apparent to those skilled in the art that various alterations, modifications and other changes may be made to the disclosure without departing from the spirit and scope of the present disclosure. It is therefore intended that the claims cover all such modifications, alterations and other changes encompassed by the appended claims.

What is claimed is:

1. A dispensing assembly, the assembly comprising:

a container comprising a plurality of panels, the panels defining a chamber and a dispensing region on the container;

a removable section in the dispensing region, the removable section having a first portion outlining a first orifice and at least a second portion outlining a second orifice such that the first portion and the second portion are merged such that the first orifice and the second orifice are each partially defined by a common edge; and a first removal component to remove only the first portion of the removable section and at least a second removal component to simultaneously remove both the first portion and at least the second portion of the removable section such that removal of the first portion forms the first orifice and removal of the second portion forms the second orifice into the chamber that incorporates the first orifice.

2. The assembly of claim 1, wherein the first portion and second portion of the removable section are each defined by one of the group consisting of perforations, scores, underscores, and partial cuts through the material of the container.

3. The assembly of claim 1, wherein the first portion of the removable section has an oval shape and the second portion of the removable section has a generally crescent shape that extends the oval shape of the first portion.

4. The assembly of claim 1, wherein the at least a second removal component is configured to remove at least the second portion of the removable section that remains after the first portion is removed.

5. The assembly of claim 1, wherein the first portion of the removable section is larger than the second portion of the removable section.

6. The assembly of claim 1, wherein the first portion and second portion are merged in at least one zone such that the first dispensing orifice and at least the second dispensing orifice are each defined by a common edge of the dispensing region.

7. The assembly of claim 1, further comprising indicia identifying at least one of the first removal component, the second removal component, the first portion of the removable section, and the second portion of the removable section.

8. The assembly of claim 1, wherein the first portion of the removable section is smaller than the second portion of the removable section.

9. The assembly of claim 1, wherein the first and second removal components are selected from the group consisting of flaps, tabs, finger recesses, and indentations.

10. A dispensing assembly, the assembly comprising:

a container comprising a plurality of panels, the panels defining a chamber and a dispensing region on the container;

a removable section in the dispensing region, the removable section having a first portion outlining a first dispensing orifice and at least a second portion outlining a second dispensing orifice adjacent to and sharing a common outer boundary with the first portion; and a first removal component to remove only the first portion of the removable section to define a first dispensing orifice into the chamber and at least a second removal component to simultaneously remove both the first portion and the second portion of the removable section to define a second dispensing orifice into the chamber that is larger than and incorporates the first dispensing orifice or to remove at least the second portion of the removable section that remains after the first portion of the removable section is removed.

11. The assembly of claim 10, wherein the first portion and second portion of the removable section in the dispensing region are each defined by one of the group consisting of perforations, scores, underscores, and partial cuts through the material of the container.

12. The assembly of claim 10, wherein the first portion of the removable section has an oval shape and the second portion of the removable section has a generally crescent shape that extends the oval shape of the first portion.

13. The assembly of claim 10, wherein the first portion of the removable section is larger than the second portion of the removable section.

14. The assembly of claim 10, further comprising indicia identifying at least one of the first removal component, the second removal component, the first portion of the removable section, and the second portion of the removable section.

15. The assembly of claim 10, wherein the first portion of the removable section occupies a first area and the second portion of the removable section occupies a second area, and wherein the first area is less than the second area.

16. The assembly of claim 10, wherein the first and second removal components are selected from the group consisting of flaps, tabs, finger recesses, and indentations.

17. A package of articles, the package comprising:

a container comprising:

a plurality of panels, the panels configured to define a chamber and a dispensing region on the container;

a removable section in the dispensing region of the container, the removable section having a first portion outlining a first dispensing orifice and at least a second portion outlining a second dispensing orifice adjacent to and sharing a common outer boundary with the first portion; and a first removal component to remove only the first portion of the removable section to define a first dispensing orifice into the chamber and at least a second removal component to simultaneously remove both the first portion and at least the second portion of the removable section to define the second dispensing orifice into the chamber that is larger and substantially incorporates the first dispensing orifice or to remove at least the second portion of the removable section that remains after the first portion of the removable section is removed;

a plurality of articles disposed within the chamber of the container, each article in communication with but not attached to another one of the same article;

whereby initial access to the plurality of articles within the chamber of the container may be obtained utilizing the first orifice and subsequent access may be obtained utilizing the second orifice or initial access to the plurality of articles may be achieved utilizing only the second orifice.

18. The package of claim 17, wherein the first portion of the removable section is larger than the second portion of the removable section.

19. The package of claim 18, wherein the first portion of the removable section is smaller than the second portion of the removable section.

* * * * *